US007096582B2

(12) United States Patent
Sayama et al.

(10) Patent No.: US 7,096,582 B2
(45) Date of Patent: Aug. 29, 2006

(54) SLIDING CONTACT AND METHOD FOR PRODUCING THE SAME

(75) Inventors: Mitsuyoshi Sayama, Hiratsuka (JP); Kenitiro Tani, Hiratsuka (JP); Hirohito Suzuki, Hiratsuka (JP)

(73) Assignee: Tanaka Kikizoku Kogyo K.K., Tokyo (JP)

( * ) Notice: Subject to any disclaimer, the term of this patent is extended or adjusted under 35 U.S.C. 154(b) by 0 days.

(21) Appl. No.: 10/486,099

(22) PCT Filed: Feb. 7, 2003

(86) PCT No.: PCT/JP03/01309

§ 371 (c)(1),
(2), (4) Date: Feb. 9, 2004

(87) PCT Pub. No.: WO03/100796

PCT Pub. Date: Dec. 4, 2003

(65) Prior Publication Data

US 2004/0205965 A1 Oct. 21, 2004

(30) Foreign Application Priority Data

May 23, 2002 (JP) ..... 2002-149236

(51) Int. Cl.
*H01R 43/00* (2006.01)

(52) U.S. Cl. ..... 29/884; 29/874; 29/878; 29/879; 219/121.66; 219/121.69

(58) Field of Classification Search ..... 29/874, 29/882, 884, 885, 878, 879, 978; 219/121.66, 219/121.69
See application file for complete search history.

(56) References Cited

U.S. PATENT DOCUMENTS

| | | | | | |
|---|---|---|---|---|---|
| 1,162,149 | A | * | 11/1915 | Eckhardt | 427/580 |
| 2,050,416 | A | * | 8/1936 | Blanchard | 219/121.11 |
| 2,803,738 | A | * | 8/1957 | Glenn | 219/121.11 |
| 3,588,433 | A | | 6/1971 | Woodlyn | |
| 3,927,887 | A | * | 12/1975 | Oda et al. | 369/173 |
| 4,320,491 | A | * | 3/1982 | Rustman | 369/126 |
| 5,315,758 | A | | 5/1994 | Ono et al. | |

FOREIGN PATENT DOCUMENTS

| | | |
|---|---|---|
| JP | 04-136683 | 5/1992 |
| JP | 04-303523 | 10/1992 |
| JP | 2001-351807 A | 12/2001 |
| JP | 2002-52027 A | 2/2002 |

* cited by examiner

*Primary Examiner*—Carl J. Arbes
(74) *Attorney, Agent, or Firm*—Rothwell, Figg, Ernst & Manbeck, P.C.

(57) ABSTRACT

The object is to provide a method of manufacturing a sliding contact which has a high yield of manufacturing sliding contacts and can positively make smooth the tip portion surface of a finger of a brush of a sliding contact. According to the invention, in a method of manufacturing a sliding contact having a metal brush, the tip portion of a finger 12*a*' of a sliding contact piece 10' is melted and thereafter the tip portion is solidified in a gas, whereby the surface of the tip portion is made smooth. For example, when a sliding contact is manufactured by blanking a metal sheet material, the tip portion of the finger 12*a*' of the brush 12' of the sliding contact piece 10' which is obtained by blanking is irradiated with a laser beam, whereby the tip portion is heated and melted. Then, a sharp portion and a burr which exist before melting disappear. When the tip portion of the finger 12*a*' is solidified in a gas after melting, a sliding contact having a brush provided with a finger whose tip portion surface is a smooth curved surface is manufactured.

5 Claims, 8 Drawing Sheets

As-pressed state (common)

(a)

(b)

First embodiment (after laser beam working)

(c)

(d)

Comparative Example 1 (after barrel polishing)

(e)

(f)

Fourth embodiment
0.3ms 0.3J/P

Second embodiment
0.5ms 0.2J/P

First embodiment
0.5ms 0.3J/P

Third embodiment
0.5ms 0.4J/P

Fifth embodiment
0.8ms 0.3J/P

Fourth embodiment
0.3ms 0.3J/P

Second embodiment
0.5ms 0.2J/P

First embodiment
0.5ms 0.3J/P

Third embodiment
0.5ms 0.4J/P

Fifth embodiment
0.8ms 0.3J/P

As-pressed state (a)

(b)

After laser beam working (c)

(d)

PRIOR ART

SLIDING CONTACT AND METHOD FOR PRODUCING THE SAME

CROSS REFERENCE TO RELATED APPLICATION

This application is a 35 USC § 371 National Phase Entry Application from PCT/JP03/01309, filed Feb. 7, 2003, and designating the U.S.

TECHNICAL FIELD

The present invention relates to a sliding contact used in sensors such as a position sensor.

BACKGROUND ART

In sensors such as a position sensor, a brush-like slider 100 as shown in FIG. 8, for example, is used in order to send and receive electrical signals, power, etc. between a member on the main body side of a sensor and an assembly (a part) which performs movements, such as rotational or linear movements, with respect to this member. In this slider 100, a sliding contact 10 in the tip portion of the slider which comes into sliding contact with a rotor etc. is an important part. The sliding contact 10 is used in a condition brought into sliding contact with an object of contact in the tip portion of each finger 12*a* which constitutes a brush 12, and it is preferred that the tip portion of the finger 12*a* be slidable as smoothly as possible. In view of this point, in the manufacturing of the sliding contact 10, the surface of the tip portion of the finger 12*a* may sometimes be worked to provide a curved surface.

For example, there is a method of manufacturing a sliding contact by blanking in press working as a method of relatively easily manufacturing a sliding contact. Schematically, this method involves fabricating sliding contact pieces having unbent tip portions (refer to sliding contact pieces 10' in FIG. 1) by the press working of a sheet material for sliding contacts and fabricating a sliding contact by further performing working. However, in the case of blanking, the periphery of the tip portion of a finger of a brush may sometimes become sharp or a burr may sometimes occur on this periphery (refer to FIG. 2(*b*)). If the tip portion of a finger is sharp or the periphery has a burr, it may be impossible to cause the tip portion of the brush 12 to slide smoothly, with the tip portion of the brush 12 kept in contact with an object of contact. Therefore, in the case of blanking, the tip portion of a finger of a brush of a sliding contact piece obtained by blanking is polished and worked to provide a curved surface thereby ensuring smooth sliding.

Barrel polishing is used as a method of polishing the tip portion of the finger 12*a* of the brush 12. Usually, the sliding contact (sliding contact piece) 10 has an about 15×15 mm size. This is because this size is suitable for performing barrel polishing, with the sliding contact put in the vessel of a barrel polishing machine. Furthermore, this is because the tip portion of a finger to be polished usually has a size of 0.1 mm (thickness)×0.4 mm (width) or a minute region smaller than this and it is difficult to polish only this part, which is possible when barrel polishing is performed.

Incidentally, in barrel polishing, a polishing medium, such as a polishing stone, and a sliding contact piece are put in the vessel of a barrel polishing machine and the whole peripheral surface of the sliding contact piece is polished by rotating the vessel. That is, in barrel polishing it is impossible to polish only the tip portion of the finger of the brush in a concentrated manner. Therefore, when barrel polishing is adopted, it is difficult to positively polish the tip portion until a sufficiently smooth state is obtained and besides variations are apt to occur in the polished state.

And some sliding contact pieces (sliding contacts) are made of a sheet material and such sliding contact pieces (sliding contacts) may sometimes be deformed due to the force received from the polishing medium during barrel polishing. Because deformed materials cannot be made as products, the problem of a decrease in the product yield arises.

However, when sliding contact pieces are to be barrel polished, it is necessary that the sliding contact pieces be beforehand brought into a state capable of being put in the vessel by separating the sliding contact pieces as a unit into individual ones. However, when once the sliding contact pieces as a unit are separated, the sliding contacts (sliding contact pieces) become less easy to handle after that. For example, it takes time and labor when the sliding contacts (sliding contact pieces) are to be aligned in the same direction and when the number of sliding contacts is to be counted. Therefore, from the standpoint of handling of sliding contacts, it is preferable to use a strip material in which a plurality of sliding contact pieces stretch in line (refer to the strip material of sliding contact pieces shown in FIG. 1). This is because transfer and counting are easy when a plurality of sliding contacts stretch as a unit. Furthermore, this is because when sliders are automatically continuously manufactured, sliding contacts can be continuously fed easily and rapidly if strip-like sliding contact pieces can be used.

DISCLOSURE OF THE INVENTION

The present invention was made in view of the above-described problems and has as its task the provision of a method of manufacturing a sliding contact which has a higher yield of manufacturing sliding contacts, can positively make smooth the tip portion surface of a finger of a brush of a sliding contact and can manufacture a strip material in which a plurality of sliding contact pieces, each provided with fingers of such a smooth surface, stretch in line as a unit.

In order to perform this task, the present inventors examined working methods by which the tip portion of a finger of a brush of a sliding contact can be positively shaped to provide a curved shape which is smooth and is proportioned well, such as a circular arc in section. As a result, finding that in the case of a metal brush, the tip portion of a finger of the brush can be made smooth by once melting the tip portion and solidifying the tip portion thereafter, the present inventors hit upon the present invention.

The invention is characterized that in a method of manufacturing a sliding contact having one or more metal fingers whose tip portion is brought into contact with an object of contact, the method has a step of melting the tip portion of a finger and thereafter making the surface of the tip portion of a finger smooth by solidifying the surface in a gas.

The step of making the tip portion of a finger smooth involves melting the tip portion of a finger of a sliding contact piece and thereafter solidifying the tip portion in a gas and is used as an intermediate step during the manufacturing of a sliding contact or as a final step. For example, in a case where a sliding contact is manufactured by blanking in press working, the tip of a finger of a sliding contact obtained by blanking is melted by heating. Then, even when a sharp portion and a burr exist before melting, they disappear. And when the surface of the tip portion is completely melted, heating is stopped and the surface is solidified in a gas. Then, a tip portion having a smooth curved surface as described above is positively formed and it is possible to manufacture a sliding contact having a brush constituted by such fingers.

Furthermore, according to such a method of manufacturing a sliding contact like this, it is possible to positively shape the tip portion of a finger of a brush of a sliding contact into a crowned shape of semicircle in section which is represented by a hemispherical shape and a semicylindrical shape. It might be thought that the reason why such a shape is obtained is that the tip portion surface of a finger of a sliding contact is characterized by a minute region and because when the tip portion surface is melted, surface tension acts to improve the surface shape. In polishing by barrel polishing and the blasting process or what is called mechanical polishing, such as paper polishing and buffing, it is very difficult to shape the tip portion of a finger into a crowned shape as described above.

Incidentally, although the tip portion surface of a finger formed in this manner is a very smooth curved surface, the tip portion of a finger of a sliding contact which is to be heated is a minute region and, therefore, it is not easy to heat only this part. Therefore, it is necessary to devise how to prevent heating portions other than the tip portion of a finger as far as possible when the tip portion of a finer is heated. This is because if portions other than the tip portion of a finger are heated to a temperature close to a melting portion, the sliding contact piece becomes apt to be deformed and because if actually deformation occurs, defective products are produced, lowering the yield. Therefore, the present inventors examined methods of heating only the tip portion of a finger.

As a result, the present inventors found that it is preferable to perform the melting of the tip portion of a finger by irradiating this portion with a beam of what is called high energy density, such as a laser beam and an electron beam (hereinafter also referred to simply as a laser beam etc). Because with such a beam, it is possible to melt only this portion by regulating the beam diameter or direction thereby to apply energy only to the tip portion of a finger. Furthermore, the use of a laser beam etc. has the advantage that it is possible to individually and positively heat and melt the tip portion of each finger by short-time irradiation. Also partly owing to such an advantage, the whole sliding contact is prevented from being heated to a temperature close to a melting point and hence deformation by heating is prevented. Furthermore, in the case of what is called a comb-teeth like brush in which fingers in the shape of a bar, in the shape of a strip of paper, etc. are arranged in parallel, adjacent fingers (comb-teeth) are positioned very close to each other and, therefore, it is difficult to separately heat the individual fingers (comb-teeth). However, with a laser beam etc., only the tip portions of the fingers (comb-teeth) can be positively melted also in such a case.

Furthermore, if a method which uses a laser beam etc. is adopted, unlike barrel polishing, by irradiating the tip portion of a finger of a sliding contact held by use of some holding jig with a beam, this portion is heated and melted, whereby the tip portion of this finger can be shaped. Therefore, this method can be applied not only to sliding contact pieces which are separated, but also to each sliding contact piece 10' which constitutes a strip material in which a plurality of sliding contact pieces stretch in line as a unit (refer to the strip material of FIG. 1). For example, with the strip material 1, in which a plurality of sliding contact pieces 10' stretch in line as a unit, held by use of a holding jig, the tip portion of a finger 12*a*' of a brush 12' which constitutes this strip material 1 is sequentially irradiated with a laser beam etc., whereby the tip portion of the finger 12*a*' is melted and its surface is shaped to provide a smooth curved state.

That is, although in a conventional method of manufacturing a sliding contact which involves using barrel polishing, it was impossible to provide a plurality of sliding contacts stretching in line as a unit in the state of a strip material, according to the method of manufacturing a sliding contact related to the present method, it is possible to provide a plurality of sliding contacts stretching in line as a unit in the state of a strip material. The strip material is large compared to the state in which the sliding contacts are separated. Therefore, the strip material is very easy to handle in transfer and feeding. In particular, in a case where sliders are automatically continuously manufactured, the presence of sliding contacts in the state of a strip material enables sliding contacts to be easily and rapidly fed, readily making it possible to simplify the manufacturing process of sliding contacts and to improve productivity.

When the tip portion of a finger of a brush is melted by irradiation with a laser beam etc., it is desirable to heat treat the tip portion after the working by irradiation. This is because although there are cases where the hardness of the tip portion of a finger obtained after solidification is not the required desirable hardness, it is possible to obtain the preferred hardness by performing heat treatment. In particular, when a hard tip portion is to be obtained, it is desirable to use an alloy which undergoes precipitation hardening by heat treatment.

According to the method of manufacturing a sliding contact related to the present invention, as already described, the tip portion surface of a finger of a brush of a sliding contact can be formed to provide a very smooth curved surface and besides it is possible to shape this tip portion into a crowned shape of semicircle in section which is represented by a hemispherical shape and a semicylindrical shape.

If a slider in which sliding contacts provided with fingers of such a tip portion are incorporated is used as a part of a potentiosensor, it is possible to cause the tip portions of the fingers slide smoothly on the surface of an object of contact. If smooth sliding is ensured, it is possible to obtain the effect that the consumption (wear) of the slider and the surface of the object of contact is minimized and the effect that a decrease in measurement accuracy is suppressed. Also, if smooth sliding is ensured, the slider slides smoothly in sensing in a state mounted in a sensor such as a potentiosensor, and hence the generation of noise in electrical signals as a result of sensing is remarkably reduced.

BEST MODE FOR CARRYING OUT THE INVENTION

Figure 1:
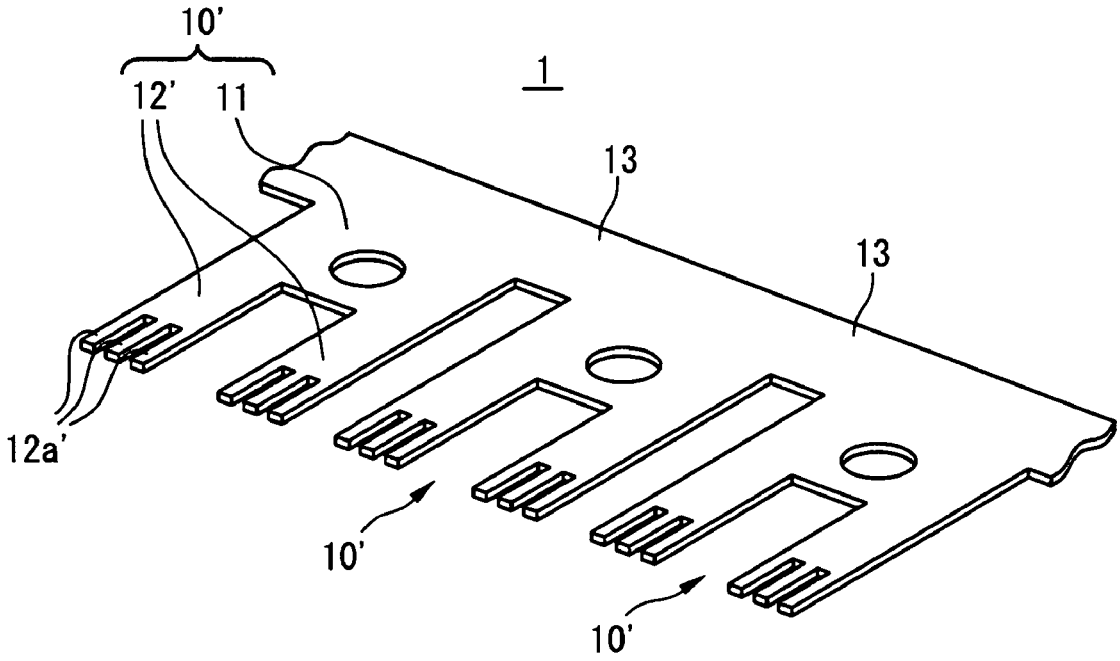
FIG. 1 is a perspective view of sliding contact pieces obtained during the manufacturing of a sliding contact of the first embodiment.

Preferred embodiments of a sliding contact related to the present invention will be described by referring to the drawings.

FIRST EMBODIMENT

A sheet material 23 mm in width and 0.07 mm in thickness was prepared by subjecting a material containing 39.5% Ag by weight, 43.0% Pd by weight, 17.0% Cu by weight and 0.5% Pt by weight to rolling etc. And by the press working of this sheet material was obtained a strip material 1 of sliding contact pieces in which a plurality of sliding contact pieces 10' stretch in line as a unit in the state of a strip as shown in FIG. 1.

Figure 2:
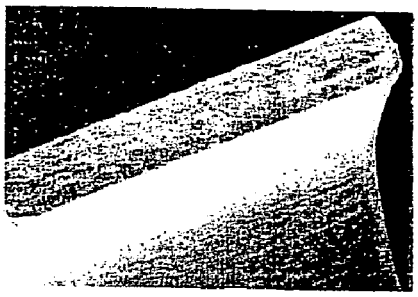
FIGS. 2(*a*) and 2(*b*) are each an enlarged photograph showing the tip portion of a finger of a brush of an as-pressed sliding contact piece, FIGS. 2(*c*) and 2(*d*) are each an enlarged photograph showing the tip portion of a finger of a brush of a sliding contact obtained in the first embodiment, and FIGS. 2(*e*) and 2(*f*) are each an enlarged photograph showing the tip portion of a finger of a brush of a sliding contact obtained in Comparative Example 1.
Figure 2:
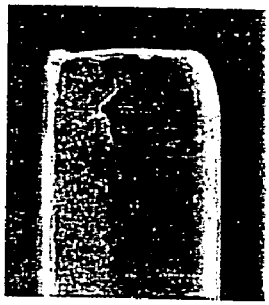
Figure 2:
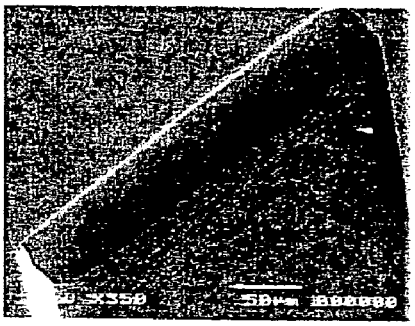
Figure 2:
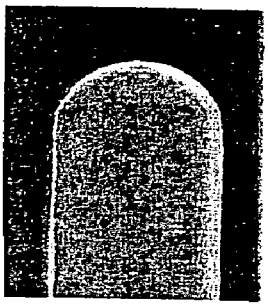
Figure 2:
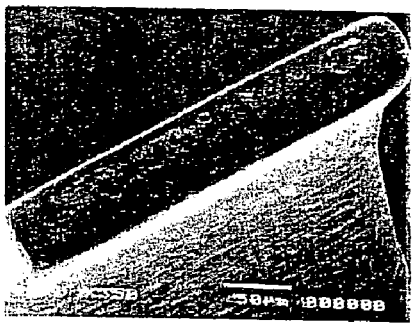
Figure 2:
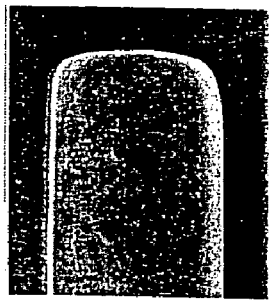

As shown in FIG. 1, each sliding contact piece 10' is constituted by a base portion 11 and two brushes 12' extending from the base portion 11 and communicates with an adjacent sliding contact piece 10' in the area of the base portion 11 via a cutting allowance 13. Each of the brushes 12' has three fingers 12' of the same length (width: 0.4 mm) disposed like the teeth of a comb. The two brushes 12' are arranged so that the fingers 12*a*' are disposed in parallel to each other and simultaneously so that the tip portions of the fingers 12*a*' are aligned in a straight line. FIGS. 2(*a*) and 2(*b*) are each a photograph showing the sate of the tip portion of a finger 12*a*'. As shown in FIG. 2(*a*), the tip portion surface of the finger 12*a*' in this stage was in an as-pressed rough state. Furthermore, as shown in FIG. 2(*b*), the shape of the tip portion of the finger 12*a*' was laterally asymmetrical and the contour of the tip portion surface showed an irregular (indefinite) curved shape.

Figure 3:
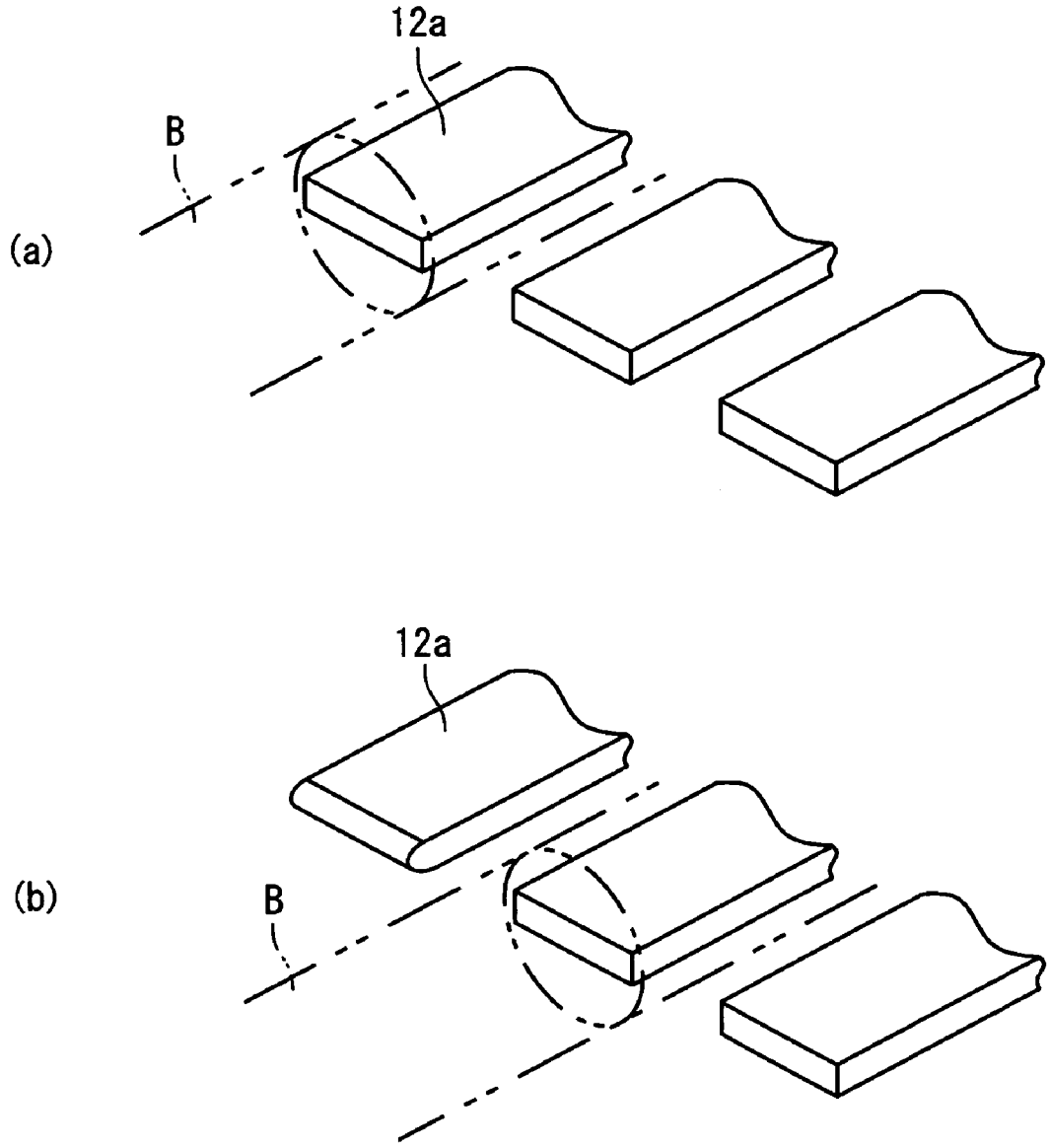
FIGS. 3(*a*) and 3(*b*) are each an enlarged perspective view showing the tip portion of a finger to explain how irradiation with a laser beam is performed and the procedure for irradiation work.

After press working, the tip portion of the finger 12*a*' of each of the sliding contact pieces 10' was irradiated with a laser beam and the surface of the tip portion was made smooth (the step of making the surface smooth). Concretely, first, the strip material 1 of the sliding contact pieces 10' was held by use of a jig (not shown) and in this state, as shown in FIG. 3(*a*), the tip portion of one of the fingers 12*a*' was irradiated with a laser beam B for a prescribed time, whereby the tip portion of the finger 12*a*' was melted and re-solidified (refer to FIG. 3(*b*)). Such irradiation with a laser beam B was performed for all of the fingers 12*a*'. Incidentally, in the first embodiment, the laser beam B was output in a pulsed manner by use of a YAG pulse as the laser medium and emitted against the tip portion of each finger 12*a*' by an amount of 1 P (pulse). The irradiation time (=pulse length) was 0.5 ms (millisecond) and the output of 1P (the quantity of energy) was 0.3 J/P. The beam diameter of a laser beam was 0.6 mm and this diameter was large enough to irradiate the whole tip portion of the finger 12*a* at a time.

Figure 8:
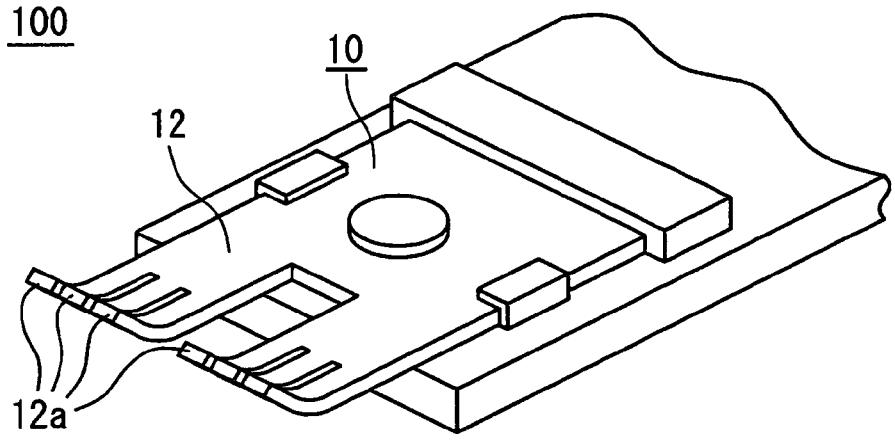
FIG. 8 is a perspective view showing an example of a conventional slider in which a sliding contact is used.

After that, the strip material 1 of the sliding contact pieces 10' was subjected to heat treatment under the heating conditions of 360° C. for 2 hours. As a result of a prior study, it is apparent that heat treatment temperatures between 0° C. and 400° C. are preferable. Therefore, the above-described temperature which is particularly preferable in this temperature range was adopted. When the Vickers hardness of an area near the tip portion of the finger 12*a*' in the sliding contact piece after the heat treatment was measured, the hardness values were 300±30 Hv. It might be thought that precipitation hardening occurred due to the heat treatment. Bending was performed after the heat treatment and a strip material in which sliding contacts 10 (refer to the sliding contact of FIG. 8) having fingers 12*a* provided with bent tip portions stretch in line as a unit. FIGS. 2(*c*) and 2(*d*) are each a photograph showing the tip portion of the obtained finger 12*a*.

As shown in FIG. 2(*c*), the surface condition of the tip portion of the finger of the obtained sliding contact was a smooth surface condition (mirror surface condition) and the shape of the tip portion was what is called a semicylindrical shape which is uniform in its entirety. Furthermore, as shown in FIG. 2(*d*), the shape of the tip portion of the finger was laterally symmetrical and the contour of the tip portion surface had the shape of a smooth circular arc in which the radius of curvature is uniform in its entirety.

COMPARATIVE EXAMPLE 1

A sliding contact was fabricated by use of a conventional manufacturing method. First, the same strip material as in the first embodiment was prepared and a strip material of sliding contact pieces 1 (refer to FIG. 1) similar to that used in the first embodiment was obtained by performing the same press working. Next, this strip material was subjected to the press working and sliding contact pieces 10' stretching in line as a unit were separated into individual sliding contact pieces 10'. Subsequently, each of the sliding contact pieces 10' was subjected to heat treatment under the same conditions as the heat treatment performed in the first embodiment. The condition of the tip portion of the finger 12*a*' after the heat treatment was the same as the condition after the press working in the first embodiment (refer to FIGS. 2(*a*) and 2(*b*)).

After that, a plurality of sliding contact 10' obtained were subjected to barrel polishing and the tip portion of the finger 12*a*' of each of the sliding contact pieces 10' was made smooth (the step of making the surface smooth). In the barrel polishing, a centrifugal barrel polishing machine provided with a vessel having a capacity of 1 l (litter) was used. Concretely, 0.7 L of polishing stones (made of alumina) each having a radius of 0.5 mm as the polishing medium and 100 sliding contact pieces 10' which had been heat treated were put in the vessel of the barrel polishing machine and barrel polishing was performed by rotating the vessel at 300 rpm for 1 hour. Sliding contacts 10 (refer to FIG. 8) were obtained by this barrel polishing. FIGS. 2(*e*) and 2(*f*) are each a photograph showing the tip portion of a finger 12*a* of a sliding contact 10 obtained after barrel polishing. When the Vickers hardness of an area near the tip portion of the finger 12*a* in the obtained sliding contact 10 was measured, the hardness values were 300±30 Hv. Incidentally, 8 out of the 100 sliding contacts were deformed by barrel polishing and unsuitable for products.

As shown in FIG. 2(*e*), on the surface of the tip portion of the finger 12*a* of the sliding contact 10 were observed a region made smooth by barrel polishing and a region remaining unpolished, and the surface was not in a uniform condition. Furthermore, the surface made smooth by polishing was not in a mirror state and was inferior in smoothness to the tip portion surface of the finger of the sliding contact obtained in the first embodiment. And the tip portion of the finger 12*a* had not a semicylindrical shape. Furthermore, as shown in FIG. 2(*f*), the tip portion shape of the finger 12*a* remained laterally asymmetrical and the contour of the tip portion surface was not a circular arc.

COMPARISON BETWEEN FIRST EMBODIMENT AND COMPARATIVE EXAMPLE 1

As is apparent from a comparison between FIGS. 2(*c*) and 2(*e*), the finger of the sliding contact of the first embodiment had significantly excellent surface smoothness compared to that of Comparative Example 1. And as is apparent from a comparison between FIGS. 2(*d*) and 2(*f*), the sliding contact of the first embodiment was excellent in the lateral symmetry of the sectional shape of the tip portion of the finger. In the sliding contact of the first embodiment, the tip portion of the finger had what is called a semicylindrical shape and the contour line of the tip portion surface of the finger was shaped to provide a circular arc almost completely. Furthermore, although eight deformed sliding contacts were produced in Comparative Example 1, no deformed one was produced in the first embodiment. From this it is apparent that in the first embodiment the yield is positively improved. Incidentally, the Vickers hardness was the same. From the above results, it is apparent that the sliding contact obtained in the first embodiment has fingers excellent in the smoothness and shape of the tip portion surface. If the tip portion surface of the finger of the sliding contact is smooth, it is possible to ensure smooth sliding when this sliding contact is actually used as a sliding contact in devices such as a position sensor. And from the above result, it is apparent that the step of making the surface smooth by irradiation with a laser beam is an excellent method of making the surface smooth and can produce excellent sliding contacts.

SECOND TO NINTH EMBODIMENTS

Figure 4:
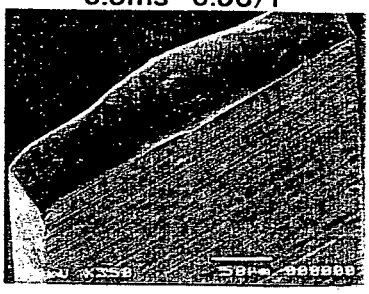
FIG. 4 shows photographs each showing the shape of the tip portion of a finger of a brush of a sliding contact obtained in the first to fifth embodiments.
Figure 4:
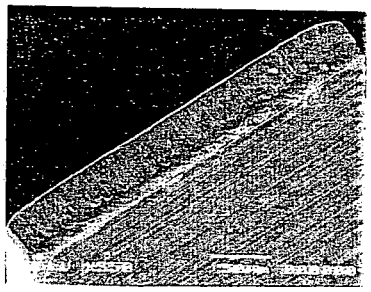
Figure 4:
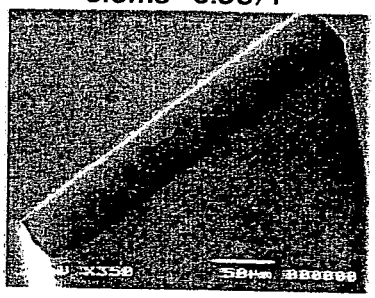
Figure 4:
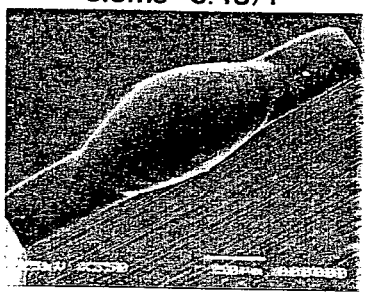
Figure 4:
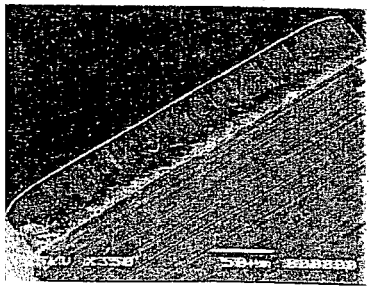
Figure 5:
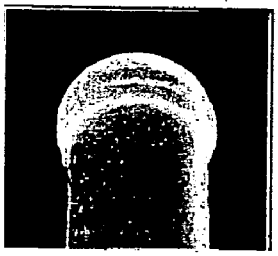
FIG. 5 shows photographs each showing the surface condition of the tip portion of a finger of a brush of a sliding contact obtained in the first to fifth embodiments.
Figure 5:
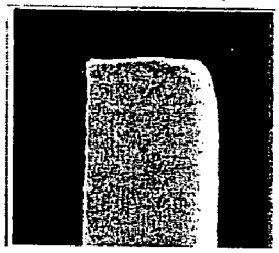
Figure 5:
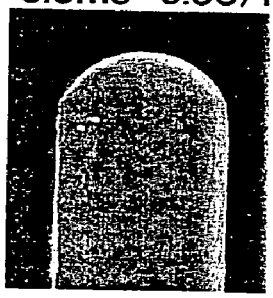
Figure 5:
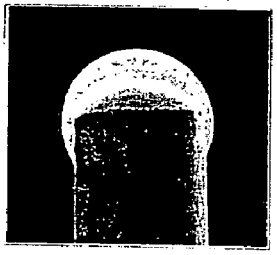
Figure 5:
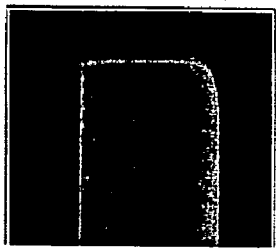

These embodiments differ from the first embodiment in the laser beam irradiation time and/or output in the step of making surface smooth. Incidentally, the laser beam irradiation time and output in each embodiment are as shown in Table 1. The condition of the brush tip portions of the sliding contacts obtained in each embodiment is shown in the photographs of FIGS. 4 and 5. Incidentally, the manufacturing conditions other than the laser beam irradiation time and output are the same as in the first embodiment and their descriptions are omitted.

TABLE 1

| | Laser beam irradiation conditions | | Condition of brush tip portion of obtained sliding contact | |
|---|---|---|---|---|
| | Irradiation time (= length of 1 P) (sec.) | Output (J/P) | Surface condition of tip portion | Shape of tip portion |
| First embodiment | 0.5 | 0.3 | E | E |
| Second embodiment | 0.5 | 0.2 | F | F |
| Third embodiment | 0.5 | 0.4 | E | F |
| Fourth embodiment | 0.3 | 0.3 | E | G |
| Fifth embodiment | 0.8 | 0.3 | F | F |
| Sixth embodiment | 0.3 | 0.25 | E | E |
| Seventh embodiment | 0.4 | 0.3 | E | E |
| Eighth embodiment | 0.6 | 0.35 | E | E |
| Ninth embodiment | 0.8 | 0.4 | E | E |

On the Surface Condition of the Tip Portion

E: The whole surface was in a very smooth condition (a mirror surface condition).

G: Almost the whole surface was smooth and the surface condition was better than that of the conventional product (Comparative Example 1).

F: As with the conventional product (Comparative Example 1), there was some region which was not smooth.

On the shape of the tip portion

E: The contour of the tip portion was an almost complete circular arch.

G: The contour of the tip portion was a practically sufficient circular arc and better than the conventional product (Comparative Example 1).

F: As with the conventional product (Comparative Example 1), there was some region which had not a circular arc or in which the thickness was not uniform.

From the first to third embodiments, it is apparent that even when the irradiation time is the same, it is impossible to make smooth the whole tip portion surface of the finger when the output is low as in the second embodiment and that when the output is high as in the third embodiment, a swollen portion considered to ascribable to the melting of the middle part of the finger is generated, resulting in a nonuniform shape. Furthermore, from a comparison between the first, fourth and fifth embodiments, it is apparent that even when the output is the same, it becomes impossible to make smooth the whole tip portion surface of the finger when the irradiation time is short as in the fourth embodiment and that when the irradiation time is long as in the fifth embodiment, a swollen portion is generated in the middle part of the finger. As a result, it is apparent that in order to give the tip portion surface of the brush a smooth curved shape by irradiation with a laser beam, it is necessary to appropriately set the laser beam irradiation time and output. And as a result of an investigation, it is apparent that the laser beam irradiation conditions of the first embodiment and the sixth to ninth embodiments are more preferred and that the conditions of the first embodiment are particularly preferred. For example, the preferred output range was 0.25 J/P to 0.35 J/P when the irradiation time was set at 0.5 ms and the preferred range of irradiation time was 0.4 ms to 0.6 ms when the output was set at 0.3 J/P. Incidentally, although the condition of the tip portions of the fingers of the sliding contacts obtained in the sixth to ninth embodiments was not shown in photographs, as with the case of the first embodiment, the surface was very smooth (a mirror surface condition) with a laterally symmetrical contour and a semicircle shape. Thus, the condition of the tip portions in the sixth to ninth embodiments was a desirable one.

TENTH EMBODIMENT

Figure 6:
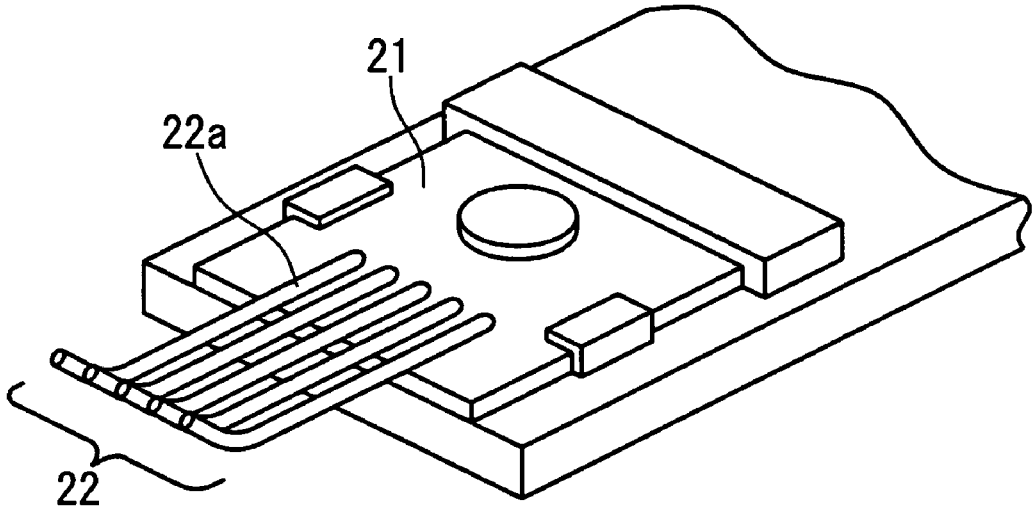
FIG. 6 is a perspective view of a sliding contact obtained in the tenth embodiment.
Figure 7:
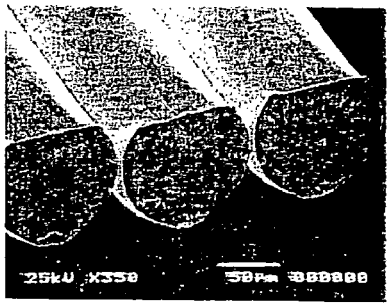
FIGS. 7(*a*) and 7(*b*) are each an enlarged photograph showing the tip portions of sliding contact pieces before irradiation with a laser beam and FIGS. 7(*c*) and 7(*d*) are each an enlarged photograph showing the tip portions of fingers of a brush of sliding contact pieces obtained in the tenth embodiment.
Figure 7:
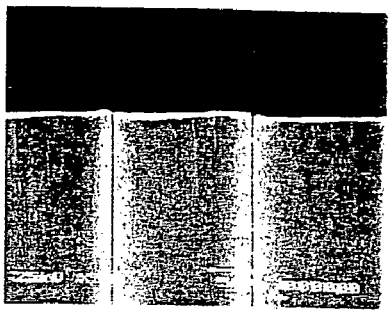
Figure 7:
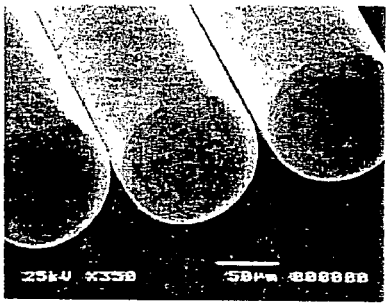
Figure 7:
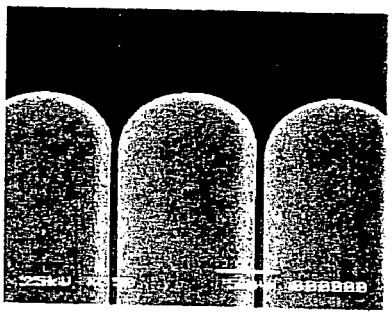

This embodiment is for manufacturing a sliding contact having a brush fabricated from an alloy wire. First, an alloy wire containing 10% Au by weight, 30% Ag by weight, 10% Pt by weight, 35% Pd by weight, 14% Cu by weight and 1% Zn by weight (diameter: 0.09 mm) was prepared and cut to a prescribed length. And by bonding the cut alloy wires were to a base 21 fabricated from a metal plate (refer to FIG. 6) by electric resistance welding so that the tip parts of the wires are aligned in a line, sliding contact pieces having fingers formed from the alloy wires were obtained. FIGS. 7(*a*) and 7(*b*) are each a photograph showing the tip portions of the fingers of the obtained sliding contact pieces. As shown in FIG. 7(*a*), the tip portion surfaces of the fingers of the sliding contact pieces showed rough sectional shapes in an as-cut state. Furthermore, as shown in FIG. 7(*b*), the sectional shapes of the tip portions of the fingers showed an almost flat surface condition and at the edge of the flat surface there were burrs considered to have been formed during cutting.

The tip portion of each of the fingers of the sliding contact pieces thus obtained was irradiated with the same pulsed laser beam as in the first embodiment by 1 P (pulse). The irradiation time (=pulse length) was 0.3 ms (millisecond) and the output of 1 P was 0.05 J/P. The beam diameter of a laser beam was 0.3 mm and this diameter was large enough to irradiate the whole tip portion of a finger 22*a* at a time. After that, the sliding contact pieces were subjected to heat treatment under the heating conditions of 360° C. for 2 hours. And by further performing bending, sliding contacts 20 having a brush 22 with bent tip portions 22*a* as shown in FIG. 6 were obtained. FIGS. 7(*c*) and 7(*d*) are each a photograph showing the tip portions of fingers 22*a* of the obtained sliding contact pieces 20.

As shown in FIG. 7(*c*), the surface condition of the tip portion of the finger of the obtained sliding contact was a smooth surface condition (mirror surface condition) and as shown in FIG. 7(*d*), the shape of the tip portion of the finger was laterally symmetrical and the contour of the tip portion surface had the shape of a smooth circular arc in which the radius of curvature is uniform in its entirety. As a result, it is apparent that the sliding contact 20 obtained in the tenth embodiment has fingers 22*a* excellent in the smoothness and shape of the tip portion surface. And it is apparent that excellent sliding contacts can be manufactured according to the tenth embodiment.

INDUSTRIAL APPLICABILITY

As described above, according to the method of manufacturing a sliding contact related to the present invention, it is possible to positively make smooth the tip portion surface of a finger of a sliding contact and the yield of manufacturing of sliding contacts increases. Furthermore, in the sliding contact related to the invention, the tip portion surface of a finger is very smooth and, therefore, by incorporating this sliding contact in a slider, it is possible to provide a slider in which the sliding in the contact is very smooth.

The invention claimed is:

1. A method of manufacturing a strip material having a plurality of sliding contacts disposed thereon, each sliding contact comprising at least one metal finger, the method comprising the steps of melting a tip portion of the at least one metal finger by sequentially irradiating each tip portion with a beam of high energy density and thereafter making a surface of each tip portion smooth by solidifying each molten tip portion in a gas.

2. The method of manufacturing a strip material according to claim 1, further comprising the step of heat treating the tip portion of the at least one metal finger of the sliding contact after it is solidified.

3. A strip material manufactured by the method of claim 1.

4. The method of manufacturing a strip material according to claim 1, wherein the beam of high energy density is a laser beam.

5. The method of manufacturing a strip material according to claim 1 wherein said sliding contact having at least one metal finger has a tip portion that is configured and arranged to be brought into contact with an object of contact.

* * * * *